United States Patent [19]

Leblanc et al.

[11] 3,970,425

[45] July 20, 1976

[54] FLAME RETARDANT PROCESS FOR TEXTILE MATERIALS INCLUDING PHOSPHORUS, HALOGEN AND ANTIMONY OXIDE

[75] Inventors: Robert Bruce Leblanc; Destin A. Leblanc, both of Wickford, R.I.

[73] Assignee: Cotton Incorporated, New York, N.Y.

[22] Filed: Apr. 15, 1974

[21] Appl. No.: 461,212

[52] U.S. Cl. ..... 8/195; 8/116 P; 8/115.6; 8/127.6; 8/181; 260/45.75 B

[51] Int. Cl.[2] ..... D06M 13/26; D06M 13/44

[58] Field of Search ..... 8/115.6, 116 P, 194, 8/195, 127.6

[56] References Cited

UNITED STATES PATENTS

| | | | |
|---|---|---|---|
| 2,519,388 | 8/1950 | Loukomsky et al. | 428/276 |
| 3,219,478 | 11/1965 | Wagner | 260/853 |
| 3,827,907 | 8/1974 | Leblanc | 117/62.1 |

*Primary Examiner*—John C. Bleutge
*Assistant Examiner*—Arthur H. Koeckert
*Attorney, Agent, or Firm*—Burns, Doane, Swecker & Mathis

[57] ABSTRACT

An improvement in a process for imparting flame retardant properties to textile materials by reacting the textile materials with phosphorus-containing compounds or salts thereof and aftertreating the textile material with a salt of a heavy metal is disclosed. In the improved process, the phosphorus-containing compounds are applied in correlation with antimony oxide and a polymeric halogen-containing material. Reduced amounts of phosphorus may be affixed on the textile material (thus substantially reducing fabric shrinkage during processing) without substantially adversely affecting the flame retardant properties of the treated material. Titanyl sulfate is utilized as the heavy metal salt. In addition, the treatment is applicable to cellulosic fibers, e.g., cotton or rayon, as well as to wool, silk and other natural and man-made fibers or blends of these fibers.

9 Claims, No Drawings

FLAME RETARDANT PROCESS FOR TEXTILE MATERIALS INCLUDING PHOSPHORUS, HALOGEN AND ANTIMONY OXIDE

BACKGROUND OF THE INVENTION

It has become a widely accepted practice in the textile industry to treat textile materials, especially cellulosic materials such as cotton or rayon, but also wool, silk and various synthetic fibers, for the purpose of rendering the material resistant to the action of flame and heat. Such practice has assumed increasing importance with the adoption of legislation designed to protect the public against the hazards of flammable fabrics in articles of clothing, toys, household articles such as curtains and drapes, and the like.

A broad group of flameproofing agents or flame retardants which have received extensive attention is represented by the inorganic and the organic phosphorus compounds. One theory to explain why such phosphorus compounds function as flame retardants for substrates, especially organic substrates such as cellulose, is that they produce phosphorus pentoxide during exposure to flame. The liberated $P_2O_5$, which is a Lewis acid, thereupon acts on the organic fiber substrate to dehydrate it, forming water and carbon, which are less flammable than the gaseous and tarry products of ordinary degradation. Another theory is that the phosphorus compounds change the path of degradation to prevent the formation of levoglucosan, to increase the amount of carbon, water and carbon dioxide and to reduce the ammount of flammable, volatile gases and flammable tars. Examples of agents which have been employed in the prior art for this purpose include salts of orthophosphoric acid and other acids of phosphorus, such as diammonium phosphate, and salts formed from mixtures of an aliphatic organic base and an acid of phosphorus. The acids of phosphorus which have been used to form salts with organic bases include, for example, orthophosphoric acid, phosphoric acid, pyrophosphoric acid, and methyl phosphonic acid. Typical organic bases include cyanamide and urea. These salts may be employed per se, or in association with haloalkyl phosphonic acid derivatives and phosphate esters, which are also flameproofing agents.

Another type of phosphorus-containing flameproofing agent comprises the haloalkylphosphonic acids and their salts, such as chloromethylphosphonic acid. These compounds react with a portion of the hydroxyl groups of the cellulose or other hydroxyl-containing fiber molecule, thereby forming ethers and chemically modifying the textile material by incorporating phosphorus into the fibers.

One of the drawbacks of such phosphorus-containing flame retardants has been their ability to undergo ion exchange when the textile material is laundered in water containing alkali metal or alkaline earth metal compounds which causes a loss of fire retardance. Thus, textiles can be rendered fire retardant by the application of a compound such as diammonium phosphate to form a monophosphate ester of cellulose, Cell-O-P(O)-$(OH)_2$, or an ammonium salt thereof. However, this fire retardance can be lost in a single laundering in water containing even small amounts of alkali metal or alkaline earth metal compounds, because of the conversion of this readily decomposable monophosphate ester or ammonium salt into an alkali metal or alkaline earth metal salt which does not decompose readily into $P_2O_5$ when heated.

These ion exchange properties are exhibited by a number of phosphorus flame retardants. The phosphorus can be in a compound linked chemically to the cellulose or in a compound which is deposited as an insoluble deposit in or on the textile fibers. The groups which are usually associated in ion exchange properties are acidic OH groups. But, ion exchange can take place with other groups which are capable of linking with metal ions such as alkali metal and alkaline earth metal ions. The groups can be attached to the phosphorus atoms or attached to other atoms which are on the textile.

Normally the metal ions that cause the most trouble during laundering are the so-called hard water ions such as calcium and magnesium. We will refer to hard water ions as being the ones causing loss of fire retardance, but it is to be understood that both the usual hard water ions and ions such as sodium and potassium can be ion exchanged by the fire retardant fabric with subsequent loss of fire retardance. The process of this invention protects the fabric not only from hard water ions, but also all of the alkali metal and alkaline earth metal ions.

No matter what the mechanism of the ion exchange, the effect on the fire retardance of the textile laundered in hard water is the same: a loss of fire retardance associated with a pick-up of hard water ions. This is theoretically due to these metals, such as calcium, tying up phosphorus during the combustion process so that phosphorus may not function as a flame retardant.

Thus, for example, it is known that cellulose can be phosphonomethylated by treatment with the sodium salt of chloromethylphosphonic acid in accordance with the equation:

$$ClCH_2P(O)(ONa)_2 + \text{Cell-OH} + NaOH \rightarrow \text{Cell-}OCH_2P(O)(ONa)_2 + NaCl.$$

When the treated textile is acidified with an acid such as hydrochloric acid, the sodium salt is transformed into the acid form of phosphonomethylated cellulose which has two free acid groups on the phosphorus atom. Whether it is in the salt form or in the free acid form, it is capable of picking up calcium ions by ion exchange when it is laundered in hard water, to form a calcium phosphonate salt which does not readily decompose.

A similar tendency toward ion exchange with calcium and other ions in hard water is found in textiles treated with salts or organic bases and phosphoric acid, which present some acid groups for ion exchange.

It has been proposed (see U.S. Pat. No. 2,728,680) to apply a mixed solution of a soluble chloride of tetravalent titanium and a soluble inorganic phosphate to cellulosic material as a flame retardant. The mixture is gelatinized and adhered onto the fabric. The solutions, however, only contain a small amount of phosphorus (0.02 to 0.17 part of phosphorus per part of titanium) and attempts to add higher proportions of phosphorus to such titanium tetrachloride solutions result in precipitation of titanium phosphate. The addition to the solution of antimony trichloride, another known flame retardant agent, is thus recommended in the patent to improve the fire resistant properties of the treated fabric, particularly after laundering.

In U.S. patent application Ser. No. 307,796, filed Nov. 20, 1972, now U.S. Pat. No. 3,827,907, there is disclosed a novel and efficacious method whereby the durability of flame retardant properties of textile materials treated with phosphorus-containing agents affixed to the material in an amount of from about 0.5 to about 5, percent of phosphorus based on the weight of the material is improved by the aftertreatment of the textile material with a salt of a heavy metal or a transition metal, i.e., a metal which is in Group I-B, IV-A, IV-B, V-A, V-B, VII-B and VIII of the Periodic Table of Elements. Titanyl sulfate has been found to be a particularly efficacious metal salt for use in that aftertreatment process.

The treatment disclosed in that aforesaid application Ser. No. 307,796, serves to increase the flameproofing effect of the flameproofing agent and protect it against ion exchange or other effects of exposure to hard water, thereby promoting flame resistance and increasing its retention over a large number of launderings.

While the treatment disclosed in the aforesaid application represents a substantial improvement in the art, the search has continued for improved methods for imparting durable flame retardance to cellulosic fiber-containing textile materials. It has been found, for example, that treatments applied to a textile material to obtain acceptable flame retardance properties may adversely affect other properties of the textile material. The textile material may shrink a substantial amount (e.g., about 10 or 20 percent or more) during treatment with a phosphorus-containing flame retardant material as compared with an untreated textile material. Other properties of the textile material may also be adversely affected.

OBJECTS AND SUMMARY OF THE INVENTION

It is an object of this invention to provide an improved method for imparting durable flame retardant properties to cellulosic fiber-containing textile materials which substantially reduces or alleviates the above-noted problems of the prior art.

It is a specific object of this invention to provide an improved method for imparting durable flame retardant properties without appreciable shrinkage of the treated textile material and the resulting product.

In accordance with one aspect of the present invention, there is provided in a process wherein durable flame retardant properties are imparted to a web of cellulosic or protein fiber material by treatment thereof with a phosphorus-containing flameproofing agent which is affixed to the fiber in an amount of from about 0.5 to about 5, percent phosphorus by weight of the fiber and which has ion exchange capability and thereafter applying to said treated web a titanyl sulfate solution to improve the durability of the flame retardant properties, the improvement which comprises applying said phosphorus-containing flameproofing agent in correlation with antimony oxide and a polymeric halogen-containing material to affix on the fiber an amount of from about 0.5 to about 10, percent of the total of (phosphorus plus antimony plus halogen) by weight of the fiber whereby said phosphorus-containing flameproofing agent is applied in reduced amounts without substantially adversely affecting the flame retardant properties of the treated web.

In accordance with another aspect of the present invention, there is provided the product of the above process.

The essence of the particular invention is the discovery that the relatively large amount of phosphorus affixed to the flame retardant textile material in prior processes (to achieve flame retardancy) can adversely affect other physical properties and that part of the phosphorus can be replaced with a mixture of antimony oxide and a polymeric halogen-containing material to achieve acceptable flame retardant properties without adversely affecting these other properties.

DESCRIPTION OF THE PREFERRED EMBODIMENTS

The materials or substrates to which the present invention is applicable include textiles or webs formed of cotton and other cellulose fibers such as linen, regenerated cellulose, viscose rayon, and partially etherified or esterified cellulosic materials; other forms of cellulosic material such as paper or wood products; proteinaceous textiles, such as wool, silk, or fiber made from casein; as well as textile blends containing one or several of the foregoing fiber types. The textile materials may be in the form of fibers, yarns, fabrics (woven, non-woven or knitted), webbing and so on.

The practice of the invention will be illustrated with regard to cotton textiles, but it is to be understood that this is for purposes of illustration, and is not to be regarded as limiting.

The present invention is especially applicable in conjunction with the process disclosed in the aforesaid U.S. patent application Ser. No. 307,796, now U.S. Pat. No. 3,827,907, in which organic or inorganic phosphorus compounds are applied to the textile material or other substrate by impregnation and chemical modification and which phosphorus compounds contain groups such as acid or hydroxy groups, that is, groups which are capable of undergoing ion exchange either in the free acid form or the salt form such as the ammonium or alkali metal salt. Examples of useful inorganic phosphorus compounds include phosphoric acid, $H_3PO_4$, its salt such as diammonium phosphate, as well as combinations of phosphoric acid with organic bases such as urea, cyanamide or dicyandiamide. However, the cellulose or other substrate may also be reacted with a phosphorus compound such as a haloalkyl phosphonic acid derivative, e.g., chloromethylphosphonic acid, to the extent that the resulting product is capable of undergoing further reaction with titanyl sulfate.

In accordance with the present invention, the phosphorus compound is applied to the fabric in correlation with antimony oxide and a polymeric halogen-containing material such that the resulting fabric contains a reduced amount of phosphorus (as compared with a similar fabric contacted with the phosphorus compound as the only flame retardant compound) without substantially detrimentally affecting the flame retardant properties of the fabric.

Generally, the phosphorus compound is applied to the substrate by impregnation with a suitable phosphorus compound-containing solution. In accordance with the present invention, the impregnation solution can also contain antimony oxide and a polymeric halogen-containing material.

Suitable polymeric halogen-containing materials include the homopolymers and copolymers of vinyl chloride and vinylidene chloride. The commercially available polyvinyl chloride- and/or polyvinylidene chloride-containing latexes (such as the "Geon" and "Polyco" latexes available from the B. F. Goodrich Chemical Co. and Borden Chemical Co., respectively)

are preferred as the polymeric halogen-containing materials.

The substrate is suitably treated to provide a total (phosphorus plus antimony plus halogen of the polymeric halogen-containing material) on the substrate of from about 0.5 to about 10, preferably from about 2 to about 6, percent by weight of the substrate. Generally, the substrate has a phosphorus content from about 0.15 to about 3, preferably from about 0.5 to about 2, percent by weight of the substrate, an antimony content of from about 0.15 to about 4, preferably from about 0.75 to about 2.5, percent by weight of the substrate, and a halogen content (from the polymeric halogen-containing material) of from about 0.15 to about 4, preferably from about 0.75 to about 2.5, percent by weight of the substrate.

The phosphorus, antimony oxide and the polymeric halogen-containing material-treated textile material is thereafter treated with a titanyl sulfate-containing solution to improve the durability of the flame retardant properties. While the aforesaid U.S. patent application Ser. No. 307,796 discloses the use of heavy metal or transition metal (i.e., those metals which fall in Groups I-B, IV-A, IV-B, V-A, V-B, VI-B, VII-B and VIII of the Periodic Chart of Elements), it has been found that titanyl sulfate is particularly advantageous with respect to durability of flame retardant properties, product color, and freedom from volatility and corrosiveness to reaction vessels of the metal salt-containing solution. As different arrangements of the Periodic Chart of the Elements are known in the art, when the terms "Periodic Chart of the Elements", "Periodic Chart" or "Periodic Table" are used in this specification, these terms shall be understood to refer to the particular arrangement which is shown at pages 56–57, *Lange's Handbook of Chemistry*, Ninth Edition, Handbook Publishers, Inc., Sandusky, Ohio (1956).

The titanyl sulfate can be applied to the pretreated flameproofed textile substrates from any suitable solvent which does not dissolve or otherwise undesirably attack the substrate and in which the titanyl sulfate used is soluble. Because of economic reasons and also because of its beneficial swelling effect on substrates such as cellulose, water is the preferred solvent but other solvents such as alcohols are also usable.

The quantity of titanium which is desirably applied to the phosphorus, antimony oxide and polymeric halogen-containing material-pretreated textile substrate is that which is effective in permitting enough of the titanium ions to become attached to the ion exchange sites of the flameproofing compound such that there are not sufficient ion exchange sites left unoccupied to cause a loss in fire retardance by picking up calcium during laundering. In practice, such an effective quantity of the titaniun is readily determined in each case by a limited number of preliminary, empirical screening tests.

As a more quantitative guideline it may be suggested that in a system using a phosphorus compound having two OH groups as the flameproofing agent and titanyl sulfate (i.e., $TiOSO_4.H_2SO_4.8H_2O$) as the heavy metal salt, the flameproofing agent will be capable of picking up about one atom of titanium per atom of phosphorus. Accordingly, in such a case it is preferred to apply the titanyl sulfate solution to the pretreated textile in a proportion producing an atomic ratio of about 1:1 for Ti to P in the treated textile. However, a satisfactory finish may generally be obtained when the Ti/P atomic ratio is in the range from 0.5:1 to 5:1, preferably from 0.75:1 to 3:1.

In applying the titanium compound to the pretreated textile substrate somewhat better metal utilization, better durability of the finish and lower strength loss of the substrate may be obtained with some systems if the phosphorus compound is in the form of an ammonium or an alkali metal salt, preferably the sodium salt, than if the phosphorus compound present on the substrate has free acid groups.

The application of the titanyl sulfate solution to the phosphorus pretreated substrate is conveniently conducted at room temperature, e.g., between 15°C. and 35°C., although higher or lower temperatures may be used.

After the titanyl sulfate is applied to the textile material containing the phosphorus flame retardant, it is allowed to react for a period of time by any suitable technique such as soaking, padding, batching, or the like and then the unreacted chemicals are washed out.

The fabrics may be washed in water with a little nonionic wetting agent. Basic materials may be added to the wash water to neutralize acidic materials in the fabric. Examples of basic materials that can be used are soda ash, ammonium hydroxide, sodium silicate, sodium phosphate, sodium borate, etc.

Although application of the antimony oxide and polymeric halogen-containing material is preferably accomplished by simultaneous application of all materials, it will be understood that the antimony oxide and polymeric halogen-containing material can be applied to the textile material before or after application of the phosphorus compound and after treatment of the phosphorus-containing material with titanyl sulfate. Regardless, the phosphorus compound is always applied to the textile material in a reduced amount (as compared with a similar textile material contacted with the phosphorus compound as the only flame retardant compound).

The invention is broadly applicable for improving any process in which a textile material is first treated with a phosphorus-containing flameproofing agent having ion exchange capability and then treated with the titanyl sulfate to improve the durability of the flame retardant properties.

Exemplifying the types of flameproofing treatments, but not limited thereto, to which the present invention is application are the phosphonomethylation of cellulosic textile materials, such as cotton, the production of which is known and described, for example, in U.S. Pat. No. 2,979,374. The cotton fibers, and the like, are reacted with an aqueous solution of an alkali metal salt of chloromethylphosphonic acid, thereby producing a phosphonomethyl ether of cellulose. Similarly, the cellulosic textile material may be one which has been treated with an aqueous solution of cyanamide and phosphoric acid, as described, for example in U.S. Pat. No. 3,567,359, or with dicyandiamide and phosphoric acid, as described in U.S. Pat. No. 3,479,211, or with phosphoric acid and urea, as described in U.S. Pat. No. 3,253,881. All of these phosphorus-containing flameproofed textile materials are thereafter contacted with a titanyl sulfate solution as described in the aforesaid U.S. patent application Ser. No. 307,796, now U.S. Pat. No. 3,827,907 to improve the durability of the flame retardant treatment.

Regardless of the particular treatment for application of the phosphorus to the substrate, utilization of the antimony oxide and polymeric halogen-containing material in conjunction therewith as defined above permits reduction in the amount of phosphorus affixed to the substrate without substantially detrimentally affecting the flame retardant, dimensional stability or other properties of the substrate.

The invention is additionally illustrated in connection with the following Examples which are to be considered as illustrative of the present invention. It should be understood, however, that the invention is not limited to the specific details of the Examples.

EXAMPLE I

Eight-ounce cotton twill is padded with a bath of 12 percent urea, 6 percent diammonium phosphate, 10 percent Polyco 2611 (a 56 percent solids vinyl chloride copolymer latex manufactured by Borden Chemical Co.), 4 percent antimony oxide, 0.4 percent Tamol SN (a sodium salt of a condensed naphthalene sulfonic acid from Rohm & Haas) and 0.45 percent Dowfax 2A1 (a sodium dodecyl diphenylether disulfonate from Dow Chemical Co.). The Tamol SN serves as a dispersant for the antimony oxide. The Dowfax 2A1 serves as a wetting agent and a latex stabilizer. Wet pick-up (W.P.U.) is 80 percent. The fabric is dried at 250°F. for 5 minutes, cured at 350°F. for 2 minutes, washed in 0.001 percent Triton X-100, extracted, soaked in a solution containing 30 percent of a titanyl sulfate cake for 5 minutes, padded out, neutralized in 0.6 percent soda ash, rinsed and dried.

Another sample of the same eight-ounce cotton twill is padded with a bath of 28 percent urea, 14 percent diammonium phosphate and 0.1 percent Triton X-100 (an ethoxylated nonylphenyl wetting agent) to a 75 percent wet pick-up. The fabric is dried at 250°F. for 5 minutes, cured at 330°F. for 6 minutes, washed in 0.6 percent soda ash, rinsed, and then extracted to remove excess water. The extracted fabric is soaked in a solution containing 50 percent of a titanyl sulfate cake for 5 minutes, squeezed to remove excess solution, neutralized in 0.6 percent soda ash, rinsed and dried.

The flame test results according to FF 3-71, the Children's Sleepwear Standard, initially and after launderings in water of 150 ppm hardness (as calcium carbonate) and shrinkage results during processing are given in Table I.

Table I

| Treating Bath Composition, % | | | Shrinkage During Processing, % in Warp Direction | Char Lengths, inches | | | |
|---|---|---|---|---|---|---|---|
| P[1] | Sb[2] | Cl[3] | | Initial | 10 Washes | 25 Washes | 50 Washes |
| 6 | 4 | 5.6 | 5 | 0.4 | 0.4 | 0.5 | 1.4 |
| 14 | — | — | 18 | 0.5 | 1.8 | 2.2 | 2.5 |

[1]Expressed as weight percent diammonium phosphate.
[2]Expressed as weight percent antimony oxide.
[3]Expressed as weight percent polyvinyl chloride solids.

These results show that the process of the present invention provides for a substantial reduction in phosphorus content affixed to the fabric with an increase in the flame retardant properties of the fabric. Shrinkage of the fabric during processing is dramatically decreased.

EXAMPLE II

A 3.5-ounce cotton broadcloth is padded with a bath of 12 percent urea, 6 percent diammonium phosphate, 9 percent Polyco 2611, 4 percent antimony oxide, 0.4 percent Tamol SN and 0.45 percent Dowfax 2A1 to a 85 percent W.P.U. The fabric is dried at 250°F. for 5 minutes, cured at 350°F. for 2 minutes, process washed in 0.6 percent soda ash, extracted, soaked in a solution containing 50 percent of a titanyl sulfate cake for 10 minutes, neutralized in 1 percent soda ash, rinsed and dried. Shrinkage in the warp direction during processing is 2.8 percent. Flame test results are entered in Table II.

EXAMPLE III

A 3.5-ounce cotton broadcloth is treated as in Example II, except that the process wash is performed in 0.001 percent Triton X-100. Shrinkage in the warp direction during processing is 2.5 percent. Flame test results are given in Table II.

EXAMPLE IV

Four ounce cotton flannelette is padded with a bath of 12 percent urea, 6 percent diammonium phosphate, 7 percent Polyco 2611, 4 percent antimony oxide, 0.4 percent Tamol SN and 0.45 percent Dowfax 2A1 to a 100 percent W.P.U. The fabric is dried at 250°F. for five minutes, cured at 350°F. for 2 minutes, process washed in 0.6 percent soda ash, extracted, soaked in a solution containing 50 percent of a titanyl sulfate cake for ten minutes, neutralized in 10 percent soda ash, rinsed and dried. Shrinkage in the warp direction during processing is 5.8 percent. Flame test results are entered in Table II.

EXAMPLE V

Four ounce cotton flannelette is treated as in Example IV except that the process wash after the cure was done in 0.001 percent Triton X-100. Shrinkage in the warp direction during processing is 5.9 percent. Flame test results are entered in Table II. (Run 5-A)

A comparative 3.3-ounce cotton flannelette sample is padded with a bath of 26 percent Polyco 2611, 12 percent antimony oxide, 0.6 percent Tamol SN and 0.45 percent Dowfax 2A1 to a 100 percent W.P.U.; dried for 5 minutes at 250°F., cured three minutes at 330°F., and process washed at 60°C. in 0.001 percent Triton X-100. The flame test results for this comparative sample which illustrates the effect of treating the cloth with antimony oxide and polymeric halogen-containing material only are shown below in Table II. (Run 5-Comp.)

EXAMPLE VI

A 3.5-ounce cotton broadcloth is padded with a bath of 12 percent urea, 6 percent diammonium phosphate, 8 percent Polyco 2611, 3.3 percent antimony oxide, 0.36 percent Tamol SN, and 0.45 percent Dowfax 2A1 to an 85 percent W.P.U. The fabric is dried at 250°F. for 5 minutes, cured at 320°F. for 2 minutes, process washed in 0.001 percent Triton X-100, soaked in 35 percent titanyl sulfate cake for 3 minutes, neutralized in 0.6 percent soda ash, rinsed and dried. Shrinkage in the warp direction is 2.6 percent. Flame test results are entered in Table II.

Table II

| Example | Char Lengths, inches[4] Initial | 10 Washes | 25 Washes | 50 Washes |
|---|---|---|---|---|
| 2 | 1.4 | — | 2.6 | 3.0 |
| 3 | 1.6 | — | 2.9 | 2.9 |
| 4 | 2.3 | — | 1.8 | 4.7 |
| 5-A | 2.8 | — | 1.4 | 4.4 |
| 5-Comp. | 3.1 | — | — | BEL[5] |
| 6 | 2.1 | 1.6 | 2.0 | 2.9 |

[4]Determined according to FF 3-71 when laundered in water of 150 ppm hardness.
[5]Burned Entire Length.

EXAMPLE VII

The procedure of Example I is repeated on a number of 8-ounce cotton twill samples. Each sample is measured to determine the shrinkage (percent in warp direction) which occurs during processing and 5 launderings. In addition, unprocessed samples of the same material are also given the same launderings.

These tests are repeated on the same fabric which has been preshrunk to yield a maximum of 1 percent shrinkage during the 5 launderings.

The fabrics and shrinkage results obtained are shown below:

| Fabric Pre-Shrunk | Fabric Treating Bath Composition P[1] | Sb[2] | Cl[3] | Shrinkage, % in Warp Direction During Processing | After Launderings |
|---|---|---|---|---|---|
| No | 6 | 4 | 5.6 | 8 | 0 |
| " | 14 | — | — | 20 | 0 |
| " | — | — | — | 0 | 10 |
| Yes | 6 | 4 | 5.6 | −1 | 0 |
| " | 14 | — | — | 11 | 0 |
| " | — | — | — | 0 | 1 |

[1]Expressed as weight percent diammonium phosphate.
[2]Expressed as weight percent antimony oxide.
[3]Expressed as weight percent polyvinyl chloride solids.

These results show that the process of the present invention affords the substantial decrease in shrinkage during processing both onto fabric which is pre-shrunk and fabric which is not pre-shrunk.

EXAMPLE VIII

A 3.5-ounce cotton broadcloth is padded with a bath of 12 percent urea, 5.2 percent mono-ammonium phosphate, 8 percent Polyco 2611, 4 percent antimony oxide, 0.4 percent Tamol SN and 0.45 percent Dowfax 2A1 to an 85 percent W.P.U. The fabric is dried for 5 minutes at 250°F., cured for 2 minutes at 350°F., washed in 0.001 percent Triton X-100, extracted, soaked for five minutes in a 35 percent solution of titanyl sulfate, padded out, neutralized in 0.6 percent soda ash, rinsed and dried. The treated fabric shows an average char length of 3.1 inches after fifty launderings when tested according to the Children's Sleepwear Standard (FF 3-71).

EXAMPLE IX

A 3.5-ounce cotton broadcloth is treated as in Example VIII except that in the place of 5.2 percent mono-ammonium phosphate, the pad bath contains 4.5 percent $H_3PO_4$. The treated fabric shows an average char length of 3.8 inches after fifty launderings when tested according to the Children's Sleepwear Standard.

EXAMPLE X

A 3.5-ounce cotton broadcloth is padded with a bath of 12 percent urea, 6 percent diammonium phosphate and 0.1 percent Triton X-100 to an 85 percent W.P.U. The fabric is dried 5 minutes at 250°F., cured two minutes at 350°F.

A portion (Run A) of the fabric is washed in 0.001 percent Triton X-100, extracted, soaked in a 35 percent solution of titanyl sulfate for 5 minutes, neutralized in 0.6 percent soda ash, rinsed and dried. The fabric is then padded to an 80 percent W.P.U. with a bath of 8 percent Polyco 2611, 4 percent antimony oxide, 0.3 percent Tamol SN, and 0.45 percent Dowfax 2A1, dried for 5 minutes at 250°F., cured for 2 minutes at 350°F., and washed in 0.001 percent Triton X-100.

Another portion (Run B) of the urea-diammonium phosphate-containing fabric is padded with a bath of 8 percent Polyco 2611, 4 percent antimony oxide, 0.3 percent Tamol SN and 0.45 percent Dowfax 2A1 at a 75 percent W.P.U., dried five minutes at 250°F., cured 2 minutes at 350°F., and washed in 0.001 percent Triton X-100. The fabric is extracted, soaked in a solution containing 35 percent titanyl sulfate for five minutes, neutralized in 0.6 percent soda ash, rinsed and dried.

The fabric from Run A shows an average char length of 3.2 inches and the fabric from Run B shows an average char length of 2.9 inches, both after 50 launderings when tested according to the Children's Sleepwear Standard (FF 3-71). Both fabrics show moderate shrinkage (less than 10 percent in the warp direction) during processing.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. In a process wherein durable flame retardant properties are imparted to a web of cellulosic or protein fiber material by treatment thereof with a phosphorus-containing flameproofing agent which is affixed to the fiber in an amount of from about 0.5 to about 5 percent phosphorus by weight of the fiber and which has ion exchange capability and thereafter applying to said treated web a titanyl sulfate solution to improve the durability of the flame retardant properties, the improvement which comprises applying said phosphorus-containing flameproofing agent in correlation with antimony oxide and a flame retardant polymeric halogen-containing material selected from the group consisting of halogenated vinyl and vinylidene polymers and copolymers to affix on the fiber an amount of from about 0.5 to about 10 percent of the total of (phosphorus plus antimony plus halogen) by weight of the fiber whereby said phosphorus-containing flameproofing agent is applied in reduced amounts as compared to the treatment without correlation with said antimony oxide and flame-retardant polymeric halogen-containing material without substantially adversely affecting the flame retardant properties of the treated web.

2. The process of claim 1 in which the material is a cotton fabric to which an aqueous solution including an organic base and a phosphorus acid compound is applied and cured and thereafter treated with said titanyl sulfate.

3. The process of claim 2 in which the organic base is urea.

4. The process of claim 3 in which the phosphorus acid compound is included in the solution as monoammonium phosphate, diammonium phosphate or as orthophosphoric acid.

5. The process of claim 1 in which the atomic ratio of titanium to phosphorus present in the treated textile material is between about 0.5:1 and about 5:1.

6. The process of claim 5 in which the atomic ratio of titanium to phosphorus present in the treated textile material is between about 0.75:1 and about 3:1.

7. The process of claim 1 wherein the antimony oxide and polymeric halogen-containing material are applied to the fabric after applying the phosphorus-containing flameproofing agent and before applying the titanyl sulfate solution.

8. The process of claim 1 wherein the antimony oxide and polymeric halogen-containing material are applied to the fabric after applying both the phosphorus-containing flameproofing agent and the titanyl sulfate solution.

9. The product of the process of claim 1.

* * * * *